US009004390B2

(12) United States Patent
Morinaga et al.

(10) Patent No.: US 9,004,390 B2
(45) Date of Patent: Apr. 14, 2015

(54) ROLL MEDIUM HOLDING UNIT, ROLL SHEET FEEDER, AND IMAGE FORMING APPARATUS

(75) Inventors: Shigeru Morinaga, Kanagawa (JP); Kazuhiro Wakamatsu, Kanagawa (JP); Takayuki Niihara, Kanagawa (JP); Kikuya Nakada, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 449 days.

(21) Appl. No.: 13/184,680

(22) Filed: Jul. 18, 2011

(65) Prior Publication Data

US 2012/0032021 A1 Feb. 9, 2012

(30) Foreign Application Priority Data

Aug. 3, 2010 (JP) ..... 2010-174835
Sep. 27, 2010 (JP) ..... 2010-215582

(51) Int. Cl.
*B65H 75/00* (2006.01)
*B65H 75/18* (2006.01)
*B65H 75/08* (2006.01)

(52) U.S. Cl.
CPC ..... *B65H 75/185* (2013.01); *B65H 75/08* (2013.01)

(58) Field of Classification Search
USPC ..... 242/596, 596.4, 596.7, 571, 572, 577, 242/577.4, 599, 599.1, 599.2, 599.4, 597.3
See application file for complete search history.

(56) References Cited

U.S. PATENT DOCUMENTS

| | | | | |
|---|---|---|---|---|
| 4,149,682 | A * | 4/1979 | Gustafson et al. | 242/571.3 |
| 4,291,844 | A * | 9/1981 | Blickley et al. | 242/571.4 |
| 6,361,229 | B1 | 3/2002 | Shinga | |
| 2003/0210312 | A1 | 11/2003 | Fujioka | |
| 2009/0194631 | A1 * | 8/2009 | Genta et al. | 242/576 |

FOREIGN PATENT DOCUMENTS

| | | |
|---|---|---|
| JP | 62-59665 | 4/1987 |
| JP | 2000-95397 | 4/2000 |
| JP | 3772057 | 2/2006 |
| JP | 3928705 | 3/2007 |
| JP | 2007-261084 | 10/2007 |
| JP | 2009-173428 | 8/2009 |

OTHER PUBLICATIONS

U.S. Appl. No. 13/049,090, filed Mar. 16, 2011.

* cited by examiner

*Primary Examiner* — Emmanuel M Marcelo
*Assistant Examiner* — Angela Caligiuri
(74) *Attorney, Agent, or Firm* — Cooper & Dunham LLP

(57) ABSTRACT

A roll medium holding unit is disclosed that includes a core part configured to be inserted in a core pipe of a roll medium; and plural diameter-increasing members configured to be variably arranged at corresponding first positions provided along a periphery of the core part and arranged at corresponding second positions provided away from the core part. The roll medium holding unit is capable of being set in a first holding state where the diameter-increasing members arranged at an outer peripheral surface of the core part support the roll medium with the diameter-increasing members arranged at the corresponding first positions and capable of being set in a second holding state where the core part of a holding member supports the roll medium with the diameter-increasing members arranged at the corresponding second positions.

5 Claims, 15 Drawing Sheets

ROLL MEDIUM HOLDING UNIT, ROLL SHEET FEEDER, AND IMAGE FORMING APPARATUS

BACKGROUND OF THE INVENTION

1. Field of the Invention

The present invention relates to a roll medium holding unit that holds a roll medium formed by winding a long sheet. The present invention also relates to a roll sheet feeder that uses the roll medium holding unit, and to an image forming apparatus that has the roll medium holding unit.

2. Description of the Related Art

Some image forming apparatuses use roll sheets (roll media) formed by winding long sheets as recording media. Such an image forming apparatus has a roll medium conveyance device that conveys a roll sheet fed out from a roll medium. In the roll medium conveyance device, however, the roll sheet may be obliquely moved or wrinkled due to slack or the like occurring when it is conveyed. In order to prevent such trouble, some roll medium conveyance devices have a mechanism that drives the roll sheet itself in a rewinding direction to apply appropriate tension to the roll sheet.

To this end, some roll medium conveyance devices have a roll medium holding unit having a holding member (referred to as a flange) arranged inside the core pipe of a roll sheet, and rotates and drives a roll sheet through the flange to control the rotation of the roll sheet. By transmitting a driving force to the roll sheet through the holding member of the roll medium holding unit, the roll medium conveyance device can apply tension to the roll sheet and perform rotation control such as the rewinding operation of the roll sheet.

However, the inner diameter of the core pipe of a roll sheet circulating on the market is not standardized and is different depending on manufacturers or the like. Therefore, in order to match the inner diameter of the core pipe of a roll sheet and the attachment diameter of a holding member to each other, an adapter is separately attached to the shaft core of the holding member or a support member provided in the core part of the holding member is shifted in the radius direction of the roll sheet to change the outer diameter of the core part.

Patent Document 1 describes a holding unit that has a separate adapter at the core part of a holding member to change the inner diameter of the core part.

Further, Patent Document 2 describes a device in which the core part of a holding member shifts a rib, which supports the inner peripheral surface of a roll sheet, in a radius direction with a cam.

The holding unit described in Patent Document 1 is simple in configuration because the adapter is only provided in the core part of the holding member. However, handling of the holding unit is complicated because the adapter is separately attached to the holding unit.

Further, the device described in Patent Document 2 requires a locking mechanism or the like in order to reliably replace a supporting member, which gives rise to a problem that the configuration of the device becomes complicated.

Moreover, in roll sheet feeders that feed roll sheets used as recording media in recent large-sized image forming apparatuses, if slack, looseness, or the like occur in the roll sheets when they are conveyed, the roll sheet are likely to be obliquely moved or wrinkled. Therefore, it is necessary to apply appropriate tension to the roll sheets.

To this end, some roll sheet feeders have a mechanism that transmits a driving force in a rewinding direction. Currently, a mainstream technique for transmitting such a driving force includes making a lengthy shaft member (spool) pass through a roll sheet, installing a holding member (flange) as a connection to a core pipe so as to rotate and hold the roll sheet, and transmitting the driving force through the spool and the flange. Thus, the known roll sheet feeders perform rotation control such as application of tension to the roll sheet and a rewinding operation.

However, it is necessary to fix the flange to the shaft of the spool because the width of the roll sheet is made different depending on the size of an image to be recorded. In order to reduce thrust backlash between the flange and the spool, known techniques employ a mechanism that locks an elastic member so as to fix the flange to the spool or the like.

However, the employment of the mechanism that locks the elastic member gives rise to a problem that it additionally requires a locking mechanism. Patent Document 3 discloses an invention that has an elastic member provided in a flange so as to fix the flange to a spool and makes it possible to install even a roll sheet having a different inner diameter while restricting the axis line directions of the spool and the flange. However, the invention still cannot solve the problem in that it employs the mechanism that fixes the elastic member and additionally requires the locking mechanism.

Patent Document 1: JP-B2-3928705
Patent Document 2: JP-A-2009-173428
Patent Document 3: JP-A-2000-095397
Patent Document 4: JP-B2-3772057

SUMMARY OF THE INVENTION

In order to solve the above problems, the present invention may provide a roll medium holding unit capable of matching a holding member and the shaft core of a roll sheet to each other with a simple configuration, and provide an image forming apparatus that has the roll medium holding unit.

The present invention may also provide a roll medium holding mechanism that can restrict a positional movement with respect to a roll-shaped recording medium and the spool of the holding member of the roll-shaped recording medium without additionally requiring a mechanism that locks the roll-shaped recording medium to the spool. The present invention may also provide a roll sheet feeder that uses the roll medium holding mechanism and an image forming apparatus that uses the roll medium holding mechanism and the roll sheet feeder.

According to an embodiment of the present invention, there is provided a roll medium holding unit including a core part configured to be inserted in a core pipe of a roll medium; and plural diameter-increasing members configured to be variably arranged at corresponding first positions provided along a periphery of the core part and arranged at corresponding second positions provided away from the core part. The roll medium holding unit is capable of being set in a first holding state where the diameter-increasing members arranged at an outer peripheral surface of the core part support the roll medium with the diameter-increasing members arranged at the corresponding first positions and capable of being set in a second holding state where the core part of a holding member supports the roll medium with the diameter-increasing members arranged at the corresponding second positions.

Other objects, features and advantages of the present invention will become more apparent from the following detailed description when read in conjunction with the accompanying drawings.

DETAILED DESCRIPTION OF THE PREFERRED EMBODIMENTS

An image forming apparatus according to the embodiments of the present invention uses a roll sheet (roll medium) formed by winding a long sheet. The roll sheet is arranged in the image forming apparatus with both ends of its core pipe held by roll sheet holding units. The roll sheet holding units have a core part inserted inside the core pipe of the roll sheet, wherein the core part has diameter-increasing members variably provided at first and second positions so as to correspond to the core pipes of different diameters. Further, the roll sheet holding units hold the roll sheet having the core pipe of a large diameter with the diameter-increasing members arranged at the core part, and hold the roll sheet having the core pipe of a small diameter with the diameter-increasing members separated from the core part.

(Embodiments)

Next, a description is given of the image forming apparatus according to the embodiments of the present invention (hereinafter described simply as the embodiments). The following description refers to a case where the image forming apparatus has two roll sheets at its upper and lower stages and sheets conveyed from the roll sheets are printed by ink jet heads, but the embodiments of the present invention are not limited to this case.

Figure 1:
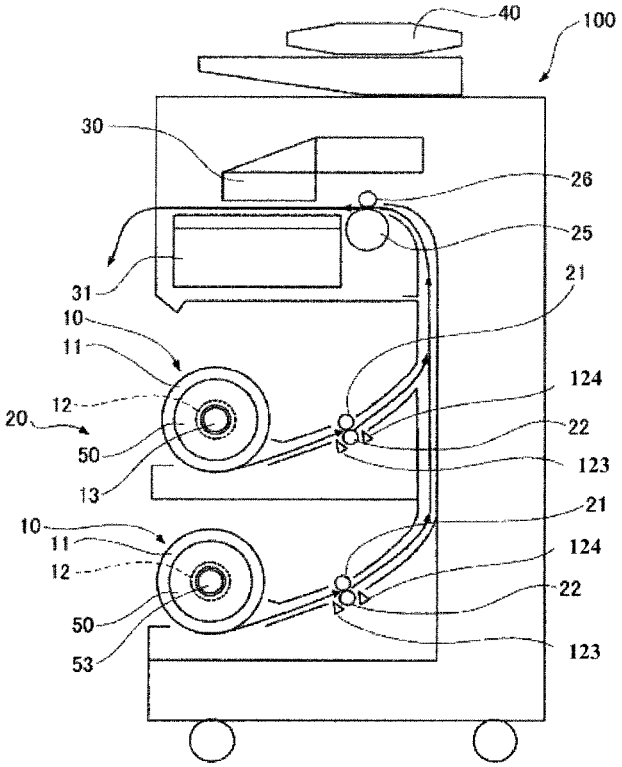
FIG. 1 is a cross-sectional view showing the schematic configuration of an image forming apparatus according to embodiments.

FIG. 1 is a cross-sectional view showing the schematic configuration of the image forming apparatus according to the embodiments. The image forming apparatus 100 is composed of a sheet feeding section 20 where the roll sheets 10 are arranged, an image forming section 30 where the sheets conveyed from the sheet feeding section 20 are printed, and an image reading section 40 where images of documents or the like are read. The sheet feeding section 20 has two roll sheet feeding stages on its upper and lower sides, and the roll sheets 10 can be loaded into the respective roll sheet feeding stages from the front (left in FIG. 1) of the image forming apparatus 100. Each of the roll sheets 10 is formed by winding the long sheet 11 on the core pipe 12 and held by the roll sheet holding units 50 serving as roll medium holding units. The sheet 11 pulled out from the roll sheet 10 at one of the sheet feeding stages is conveyed to a conveyance roller 25 and a pressure roller 26 arranged above the sheet feeding section 20 while being held by a sheet feeding roller 21 and a sheet feeding pressure roller 22. Then, the sheet 11 is fed to a conveyance section 31 by the conveyance roller 25 and printed by the image forming section 30 having the ink jet heads. Note that the roll medium is not limited to a sheet but may include other recording media such as fabrics and synthetic resin sheets. Further, the image forming section 30 may form an image according to other methods such as electrophotographic methods and sublimation methods.

An image formed by the image forming section 30 is read by the image reading section 40 or transmitted from a higher-level apparatus such as electronic information equipment. After the image formation, the sheet is cut to a predetermined length by a cutting unit (not shown) and rewound by the reverse rotations of the conveyance roller 25 and the sheet feeding roller 21. At this time, a driving force is transmitted to a driving shaft 13 to rotate in reverse the roll sheet 10. The sheet is rewound back to the conveyance roller 25. Further, the sheet of the upper sheet feeding stage is rewound back to the sheet feeding roller 21 when it is to be switched to the other sheet feeding stage.

(First Embodiment)

Figure 2:
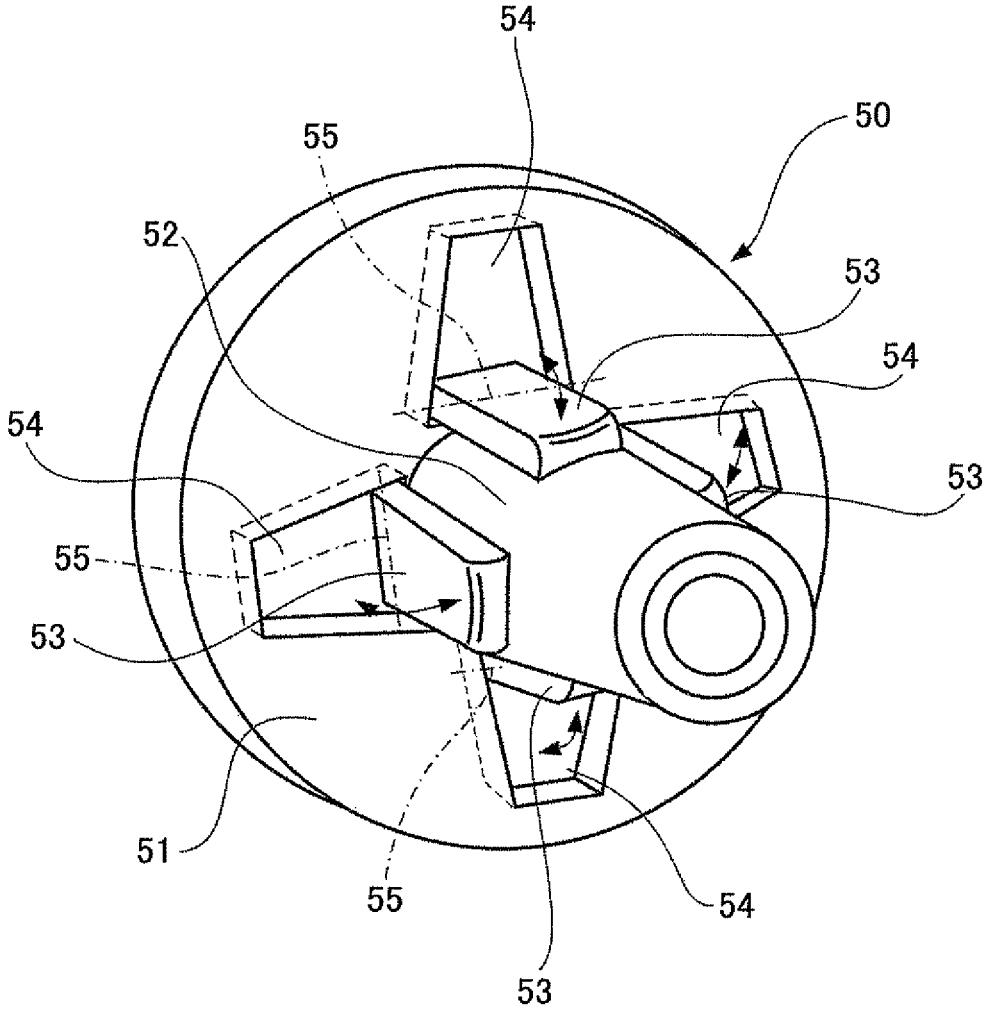
FIG. 2 is a perspective view showing a roll sheet holding unit (roll medium holding unit) according to a first embodiment.

Next, a description is given of roll sheet holding units 50 according to a first embodiment. FIG. 2 is a perspective view showing one of the roll sheet holding units according to this embodiment. The roll sheet holding units 50 serving as the roll medium holding units according to this embodiment are arranged at both ends of the roll sheet 10 and hold the roll sheet 10. Each of the roll sheet holding units 50 has a disk-shaped contact plate 51 brought into contact with corresponding the one of the ends of the roll sheet 10, and has a core part 52 arranged to project at the central part of the contact plate 51 and be inserted inside the core pipe 12 of the roll sheet 10. The roll sheet holding units 50 are integrated with or separated from the contact plates 51 and the core parts 52. Further, each of the roll sheet holding units 50 has four diameter-increasing members 53 at the outer periphery and parallel to the axis line of the core part 52.

The diameter-increasing members 53 are substantially-square members curving along the outer periphery of the core part 52 and arranged at the outer periphery of the core part 52 at substantially even intervals. Further, the diameter-increasing members 53 are arranged in a manner capable of turning about rotation supporting points 55, which are provided at the base parts of the core part 52 so as to be parallel to the circumferential direction thereof, toward directions in which the diameter-increasing members 53 may extend from the core part 52. Moreover, in this embodiment, the contact plate 51 has concave accommodation parts 54 that accommodate the extended diameter-increasing members 53.

The roll sheet holding units 50 according to this embodiment correspond to core pipes of two types having large and small diameters, where the outer shape of the core part 52 is set to be slightly smaller than the inner diameter of the core pipe of the small diameter, and the thicknesses of the diameter-increasing members 53 are set such that the maximum diameter of a circle circumscribing the outer peripheries of the diameter-increasing members 53 become slightly smaller than the inner diameter of the core pipe of the large diameter in a state where the diameter-increasing members 53 are arranged around the core part 52.

When the diameter-increasing members 53 turn about the rotation supporting points 55, the diameter-increasing members 53 can be arranged at first positions where they are close and parallel to the core part 52 or arranged at second positions where they extend outward with the rotation supporting points 55 as axes and separate from the core part 52. Thus, the roll sheet holding unit 50 changes the holding diameter to accommodate the roll sheet 10 so as to correspond to the diameter of the core pipe 12 of the roll sheet 10. The roll sheet holding units 50 according to this embodiment can correspond to the core pipe 12 of the large diameter with the diameter-increasing members 53 provided at the first positions and can correspond to the core pipe 12 of the small diameter with the diameter-increasing member 53 provided at the second positions. The diameter of the core part 52 and the thicknesses of the diameter-increasing members 53 can be set in accordance with the inner diameter of the core pipe 12 of the roll sheet 10 to be held.

Figure 3:
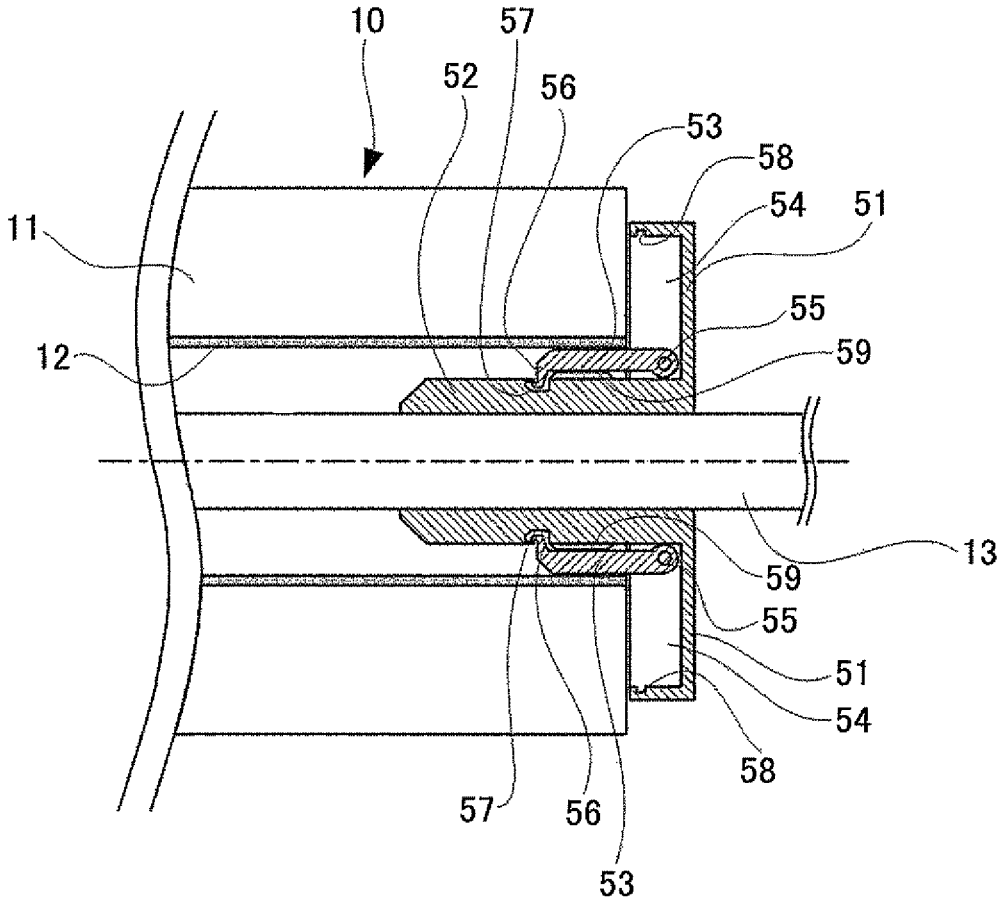
FIG. 3 is a partial cross-sectional view of the roll sheet holding unit according to the first embodiment.
Figure 4:
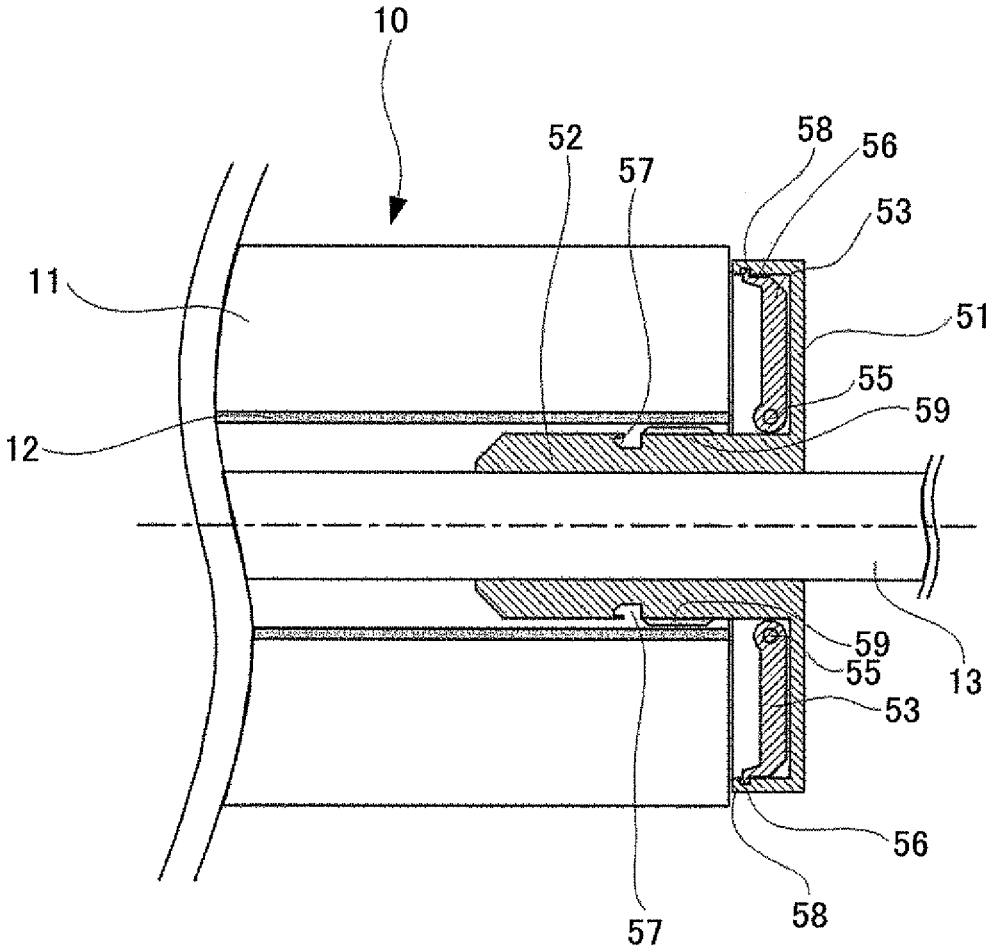
FIG. 4 is a partial cross-sectional view of the roll sheet holding unit according to the first embodiment.

Next, a description is given of a case where the roll sheet 10 is held by the roll sheet holding units 50 according to this embodiment. FIGS. 3 and 4 are partial cross-sectional views of the roll medium holding unit according to this embodiment. First, as shown in FIG. 3, when the roll sheet 10 having the core pipe of a large diameter is held, the diameter-increasing members 53 are rotated about the rotation supporting points 55 and arranged at the positions close to the core part 52, i.e., at the first positions. At this time, the diameter-increasing members 53 are held by the inner peripheral surface of the core pipe 12 and the outer peripheral surface of the core part 52. Consequently, the diameter-increasing members 53 become stable at their positions, whereby the roll sheet 10 can be reliably held.

On this occasion, it is not necessary to provide a locking unit or the like that fixes the diameter-increasing members 53. However, as shown in FIG. 3, if engagement claws 56 serving as holding mechanisms are provided in the diameter-increasing members 53 and engagement holes 57 serving as holding mechanisms are provided in the core part 52, the diameter-increasing members 53 can be easily held. Moreover, if elastic members 59 deformed in the radius direction of the roll sheet are provided between the core part 52 and the diameter-increasing members 53, contact pressure can be reliably applied onto the inner peripheral surface of the core pipe 12 by the diameter-increasing members 53 even in a case where the inner diameter of the core pipe 12 is slightly different.

On the other hand, as shown in FIG. 4, when the roll sheet 10 having the core pipe 12 of a small diameter is attached to the roll sheet holding unit 50, the diameter-increasing members 53 provided in the roll sheet holding unit 50 are turned about the rotation supporting points 55 and arranged at the second positions. Here, the diameter-increasing members 53 are accommodated in the accommodation parts 54. Further, the diameter-increasing members 53 are arranged at positions deeper than a position where the end surface of the roll sheet 10 is brought into contact with the contact plate 51. When the inner periphery of the core pipe 12 of the roll sheet 10 is brought into contact with the core part 52 in this state, the roll sheet 10 is held. At this time, the diameter-increasing members 53 are not brought into contact with the core pipe 12 and are separated from the end surface of the roll sheet 10. Therefore, the rotation of the roll sheet 10 is not hindered.

Further, if the engagement claws 56 are provided in the diameter-increasing members 53 and the engagement holes 58 serving as the holding mechanisms are provided in the contact plate 51 (such as in FIG. 4), the diameter-increasing members 53 can be easily held. At this time, if the elastic members 59 are provided in the core part 52, contact pressure can be reliably applied onto the inner peripheral surface even in a case where the inner diameter of the core pipe 12 is slightly different. Further, if the driving shaft 13 is connected to the roll sheet holding units 50, a driving force can be transmitted.

(Second Embodiment)

Figure 5:
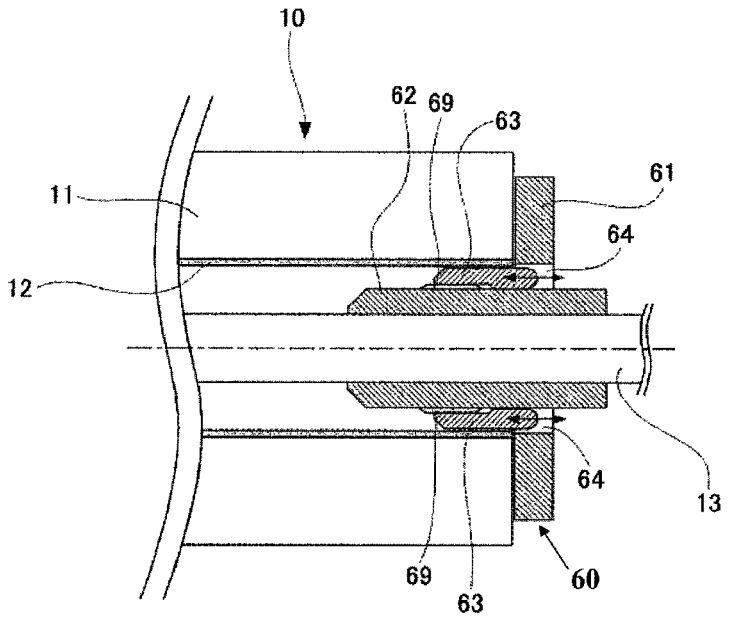
FIG. 5 is a cross-sectional view showing a roll sheet holding unit (roll medium holding unit) according to a second embodiment.
Figure 6:
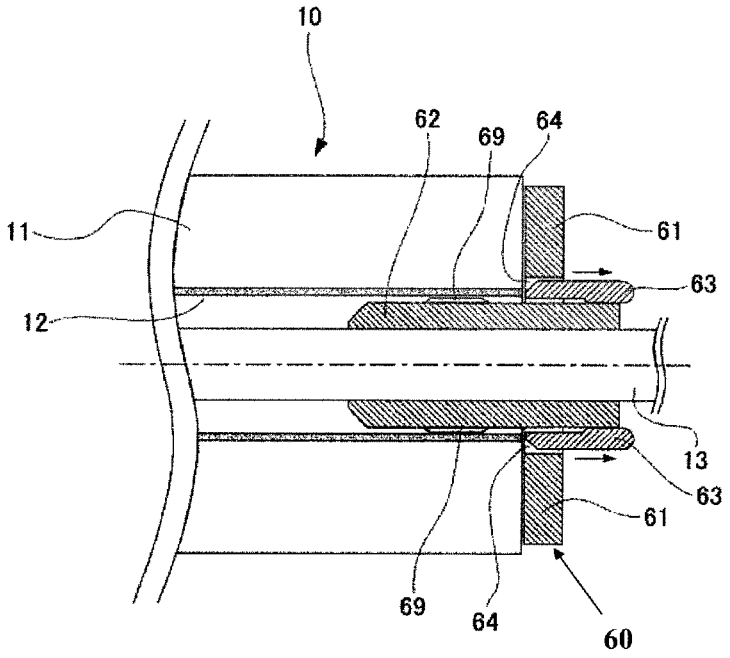
FIG. 6 is a cross-sectional view showing the roll sheet holding unit according to the second embodiment.

Next, a description is given of a second embodiment. FIGS. 5 and 6 are cross-sectional views showing a roll sheet holding unit according to this embodiment. The roll sheet holding unit 60 according to this embodiment is composed of a contact plate 61, a core part 62, and diameter-increasing members 63. Further, the diameter-increasing members 63 are configured such that they can move on the outer peripheral surface of the core part 62 along its axial direction, and the contact plate 61 has hole parts 64 in which the diameter-increasing members 63 are inserted. Further, elastic members 69 are arranged at the diameter-increasing members 63. Here, the diameter of the core part 62 and the thicknesses of the diameter-increasing members 63 are the same as those of the first embodiment.

As shown in FIG. 5, when the roll sheet 10 having the core pipe 12 of a large diameter is attached to the roll sheet holding unit 60 according to this embodiment, the diameter-increasing members 63 are arranged inside the end part of the roll sheet 10 along the outer peripheral surface of the core part 62. In this state, the inner peripheral surface of the core pipe 12 of the roll sheet 10 is brought into contact with the outer peripheral surfaces of the diameter-increasing members 63, whereby the roll sheet 10 is reliably held by the core pipe 12.

In this state, the elastic members 69 apply a biasing force to the diameter-increasing members 63 in a direction in which the radius of the roll sheet 10 is expanded. Thus, the diameter-increasing members 63 are brought into contact with the inner peripheral surface of the core pipe 12, whereby the roll sheet 10 is reliably held.

On the other hand, as shown in FIG. 6, when the roll sheet 10 of a small diameter is attached to the roll sheet holding unit 60, the diameter-increasing members 63 are slid from the hole parts 64 to the outside of the end part of the roll sheet 10 along the outer peripheral surface of the core part 62. In this state, the inner peripheral surface of the core pipe 12 of the roll sheet 10 is brought into contact with the elastic members 69 provided in the core part 62, whereby the roll sheet 10 is reliably held.

(Third Embodiment)

Figure 7:
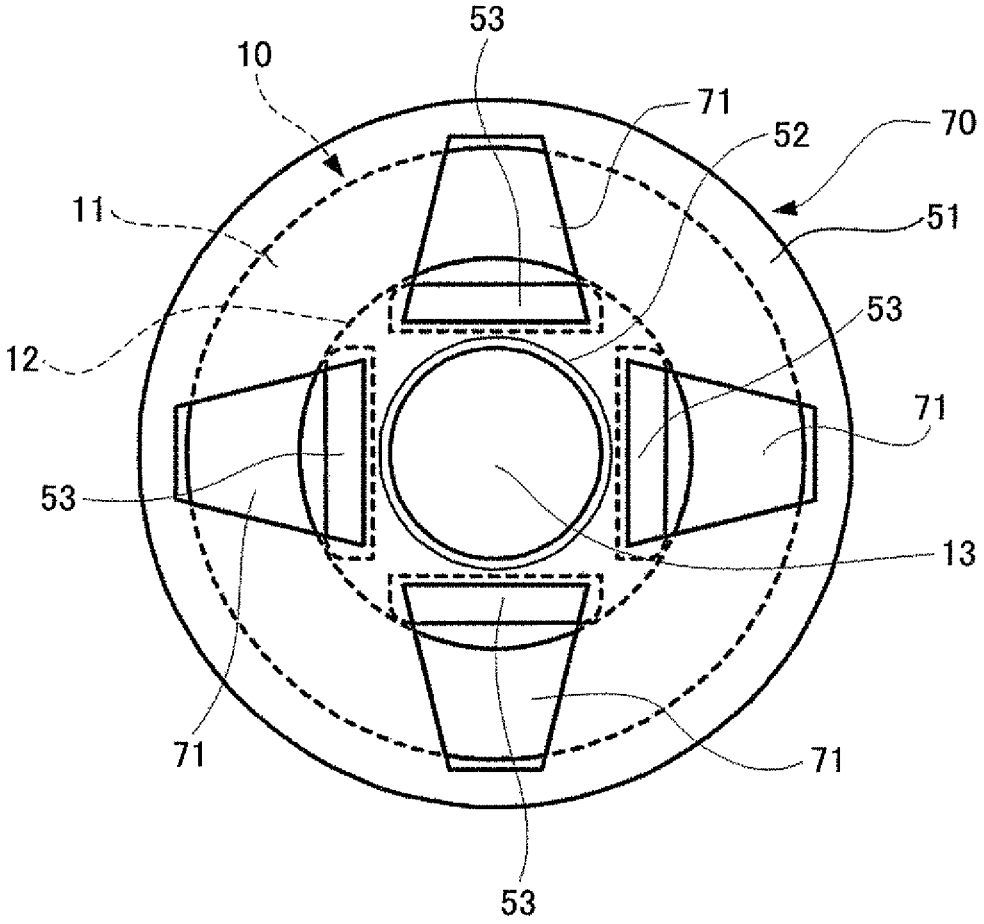
FIG. 7 is a side view showing a roll sheet holding unit (roll medium holding unit) according to a third embodiment.
Figure 8:
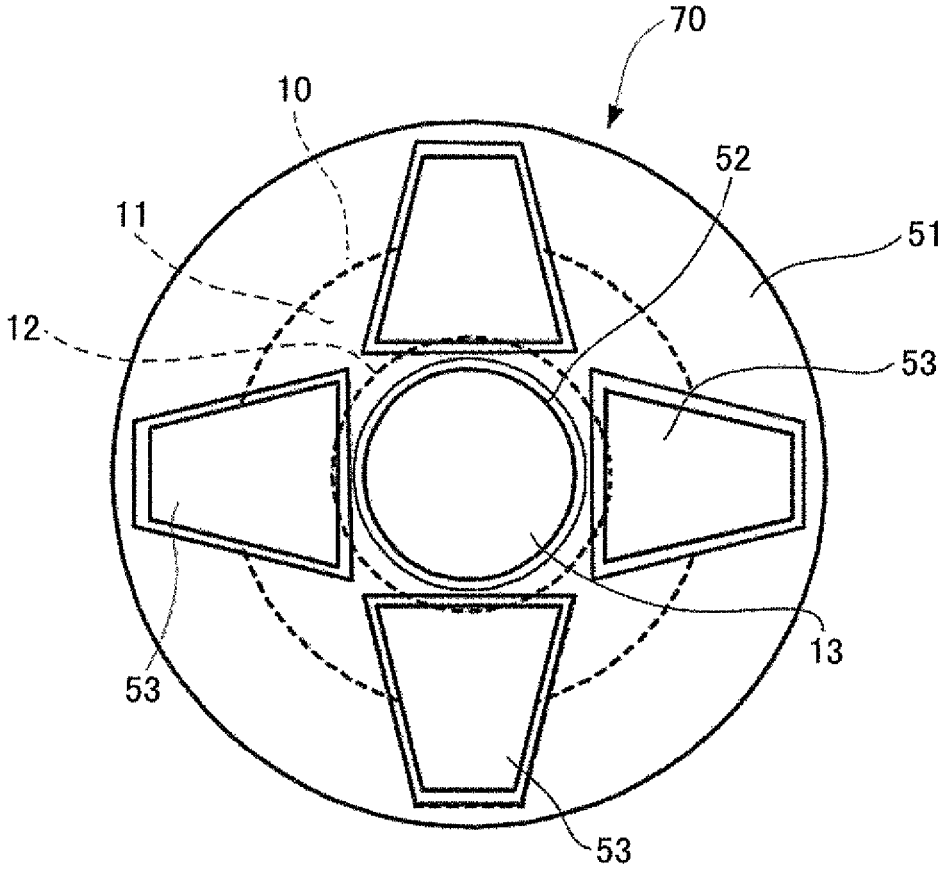
FIG. 8 is a side view showing the roll sheet holding unit according to the third embodiment.

Next, a description is given of a third embodiment. FIGS. 7 and 8 are side views showing a roll sheet holding unit according to the third embodiment. The contact plate 51 of the roll sheet holding unit 70 according to this embodiment has through-holes 71 for confirming the roll sheet 10. In the roll sheet holding unit 70 according to this embodiment, the roll sheet 10 can be observed from the through-holes 71 in a state where the roll sheet 10 is held. In other words, as shown in FIG. 7, in a case where the roll sheet 10 having the core pipe 12 of a large diameter is held, it is possible to confirm from the through-holes 71 a state in which the diameter-increasing members 53 are arranged between the core pipe 12 and the core part 52.

On the other hand, as shown in FIG. 8, in a case where the roll sheet 10 having the core pipe 12 of a small diameter is held, the through-holes 71 are shielded by the diameter-increasing members 53. In the roll medium holding units according to this embodiment, it is possible to confirm the diameter of the core pipe 12 of the held roll sheet 10.

An apparatus according to fourth and fifth embodiments of the present invention has the following characteristics about a member that rotates and holds a roll sheet serving as a roll-shaped recording medium (i.e., a roll medium). In short, it is characterized that elastic members provided in a flange restrict the rotation of the roll sheet and fix the flange and a spool in a thrust direction.

To this end, a roll medium holding mechanism (i.e., a roll medium holding unit) is attached to a holding member that holds a roll-shaped medium, and has the elastic members deformable in a radius direction. Thus, the holding member is rotated and supported. Further, the roll medium holding mechanism has a shaft member capable of moving in an axis-line direction. When the roll sheet is attached to the roll medium holding mechanism, the elastic members apply contact pressure not only to the inner peripheral surface of the core pipe diameter of the roll medium but also to the shaft member. Thus, the movements of the holding member and the shaft member in the axis-line direction are restricted. Moreover, the elastic members fixed onto the holding member apply the contact pressure not only to the inner peripheral surface of the core pipe of the roll sheet but also to the shaft member. Thus, the movements of the holding member and the shaft member in the axis-line direction are restricted without a separate locking mechanism.

Further, when a friction member, which is provided at a surface where the elastic members are brought into contact with the shaft member, contacts the shaft member, a restricting force in the axis-line direction is enhanced. Thus, backlash in the axis-line direction can be more effectively restricted.

Further, a releasing member is attached to the flange such that it is slidable and hooks into the ends of the elastic members with its tip end. Accordingly, when the releasing member is extracted from the flange, the ends of the elastic members are pulled by the releasing member and the contact pressure applied to the inner peripheral surface of the roll sheet and the outer peripheral surface of the spool are cancelled. Then, when the releasing member is extracted as it is, it hooks into the flange. Therefore, the flange can be easily drawn from the core pipe of the roll sheet only by the extraction of the releasing member.

Further, a guide is provided around the core part of the holding member. Thus, it is possible to improve the attachment of the roll sheet to the flange, reduce positional deviation between the center of the roll sheet and the center of the shaft member, and avoid unnecessary deformation of the elastic members.

Next, a description is given, with reference to the accompanying drawings, of a fourth embodiment of the present invention. Although an example of an ink jet recording apparatus serving as an image forming apparatus according to the present invention is described with reference to FIGS. 9 and 10, the present invention is not limited to the embodiment carried out by the apparatus shown in FIGS. 9 and 10.

(Fourth Embodiment)

Figure 9:
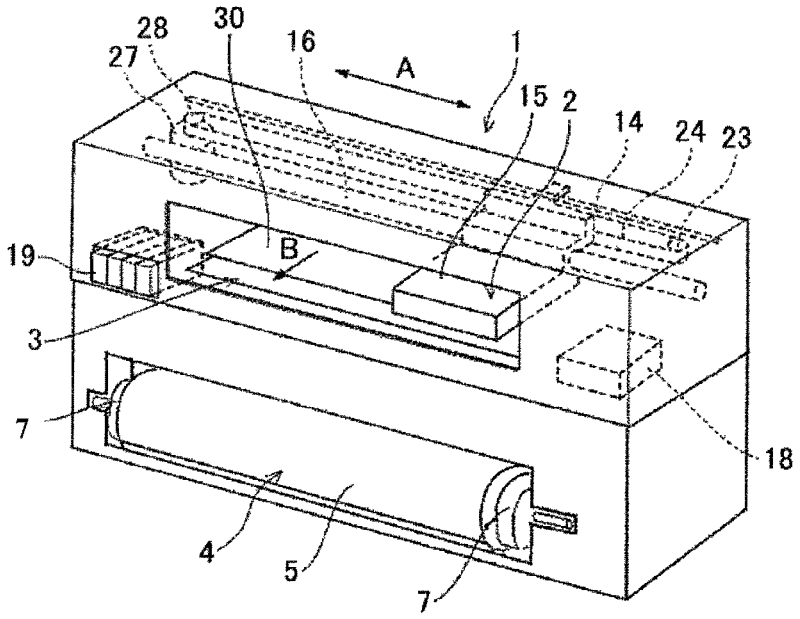
FIG. 9 is a perspective view showing the entire configuration of an ink jet recording apparatus.
Figure 10:
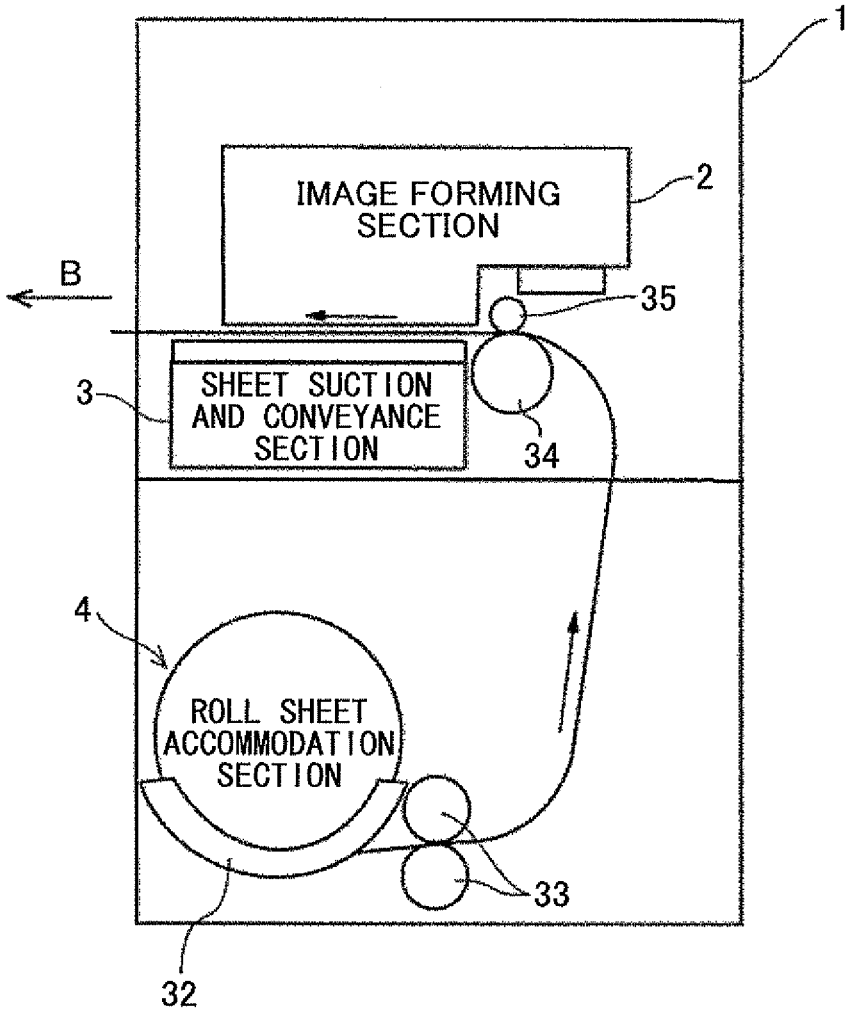
FIG. 10 is a schematic side view of the ink jet recording apparatus.

FIG. 9 is a perspective view showing the entire configuration of the ink jet recording apparatus, and FIG. 10 is a schematic side view of the ink jet recording apparatus. The ink jet recording apparatus shown in FIGS. 9 and 10 is a serial-type ink jet recording apparatus, and has an image forming section 2, a sheet suction and conveyance section 3, a roll sheet accommodation section 4, and the like inside a recording apparatus main body 1. In the image forming section 2, a guide rod 16 and a guide rail 14 are bridged between both side plates (not shown), and a carriage 15 is held by the guide rod 16 and the guide rail 14 so as to be slidable in directions as indicated by arrow A.

The carriage 15 has mounted liquid ejection heads that eject ink droplets of the respective colors of black (K), yellow (Y), magenta (M), and cyan (C). Although not shown in FIGS. 9 and 10, the respective recording heads are integrally formed with a sub-tank that supplies ink to the respective recording heads. Further, a main scanning mechanism, which moves the carriage 15 for scanning, has a driving motor 27 arranged on one side in a main scanning direction, a driving pulley 28 rotated and driven by the driving motor 27, a driven pulley 23 arranged on the other side in the main scanning direction, and a belt member 24 stretched around the driving pulley 28 and the driven pulley 23.

Note that tension is applied by a tension spring (not shown) to the driven pulley 23 outwardly (in a direction away from the driving pulley 28). Because part of the belt member 24 is fixed and held by a belt fixing part provided on the rear surface side of the carriage 15, the belt member 24 tows the carriage 15 in the main scanning directions (in the directions as indicated by arrow A in FIG. 9).

Further, an encoder sheet (not shown) for use in detecting the main scanning position of the carriage 15 is arranged along the main scanning direction of the carriage 15, and an encoder sensor (not shown) provided in the carriage 15 reads the encoder sheet.

In the recording area of a main scanning area by the carriage 15, a sheet 5 is intermittently conveyed by the sheet suction and conveyance section 3 in a direction orthogonal to the main scanning direction of the carriage 15 (sub-scanning direction, i.e., a direction as indicated by arrow B in FIG. 9). Further, in one end-side area of the main scanning area, a maintenance and restoration mechanism 18 is arranged that maintains and restores the respective recording heads. Moreover, outside a carriage movement area in the main scanning direction, or in the other end-side area of the main scanning area, main cartridges 19, which accommodate the respective colors of ink to be supplied to the sub-tanks of the recording heads, are detachably installed in the recording apparatus main body 1.

The roll sheet accommodation section 4 serves as a so-called sheet feeding unit and accommodates the roll sheet (sheet) 5, but it can also accommodate a roll sheet of a different size in a width direction (the direction as indicated by arrow A in FIG. 9). The roll sheet 5 has flanges 7 serving as holding members attached to a sheet shaft on both its sides, and is attached to the apparatus main body 1. The flanges 7 are rotatably supported by the apparatus main body of the image forming apparatus through bearings or the like (omitted in FIG. 9). As the flanges 7 rotate, the roll sheet 5 is fed. Note that reference numeral 32 in FIG. 10 denotes a supporting member that supports the lower side of the roll sheet 5 in the roll sheet accommodation section 4. Note that in the following description, the roll sheet is referred to as the roll sheet 5 or the sheet 5 as occasion demands.

In this recording apparatus, the sheet 5 supplied from the roll sheet accommodation section 4 is conveyed by conveyance units (such as a pair of rollers 33, and a resist roller 34 and a resist pressure roller 35 each serving as a conveyance roller) to the recording area from the rear side to the front side in the space of the recording apparatus main body 1 of FIG. 10. Then, the carriage 15 is moved in the main scanning direction, and the recording heads are driven in accordance with image information to eject liquid droplets. Thus, a desired image is formed on the sheet 5. Moreover, the sheet 5 after the image formation is cut into a predetermined length and discharged onto a sheet catching tray (not shown) arranged on the front surface side of the apparatus main body 1.

Figure 11:
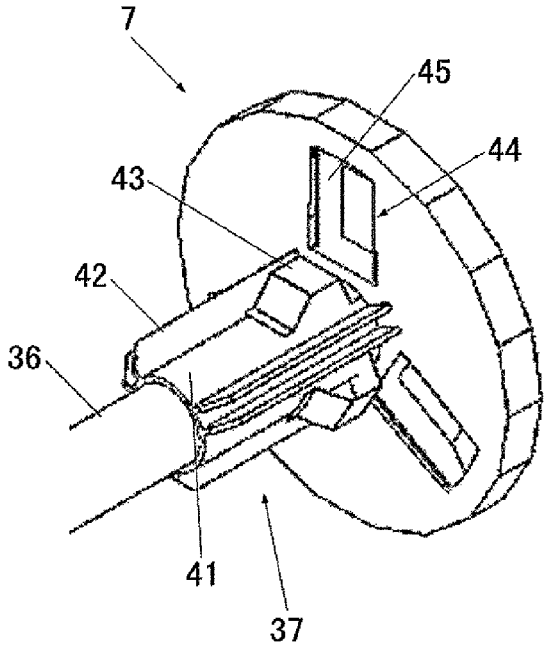
FIG. 11 is a perspective view showing the configuration of a flange according to a fourth embodiment.

FIG. 11 is a perspective view showing the configuration of the flange 7. The flange 7 has a core part 37 that is brought into contact with the inner periphery of the core pipe of the roll sheet 5 to support the roll sheet 5. The core part 37 has a cylindrical part 41 that fits over the end of a shaft member 36 constituting a spool together with the flange 7, guides 42 that project from the outer periphery of the cylindrical part 41 in a radius direction and may be brought into contact with the inner surface of the core pipe of the roll sheet 5, and plural elastic members 43 arranged between the guides 42. The elastic members 43 are deformable in the radius direction of the roll sheet 5. Further, the flange 7 has plural concave parts 44 formed in its surface on the side of the core part 37. Inside the plural concave parts 44, supporting members 45 are respectively arranged that are turned between the core part 37 and the concave parts 44. Note that the rotation supporting points of the supporting members 45 are provided inside the concave parts 44 (see FIGS. 14 and 15 to be described below). Further, respective parts constituting the core part 37 may be integrally or separately formed.

Figure 12:
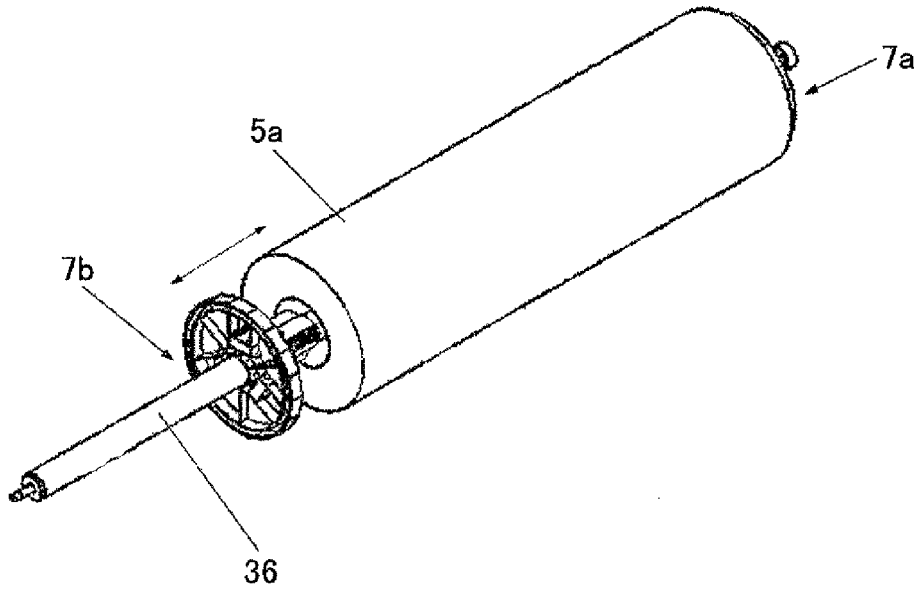
FIG. 12 shows a state where the flanges, a shaft member constituting a spool, and a roll sheet are assembled together.

In FIG. 12, the flanges 7, the shaft member 36 constituting the spool, and the roll sheet 5 are assembled together. The flanges 7 are composed of two types of flanges, one being fixed to the shaft member 36 and the other being movable in the axis-line direction of the shaft member 36. The flange 7*a* is fixed to the shaft member 36, while the flange 7*b* is movable in the thrust direction of the shaft member 36, i.e., the axis-line direction, so as to comply with the size of the roll sheet 5.

Figure 13:
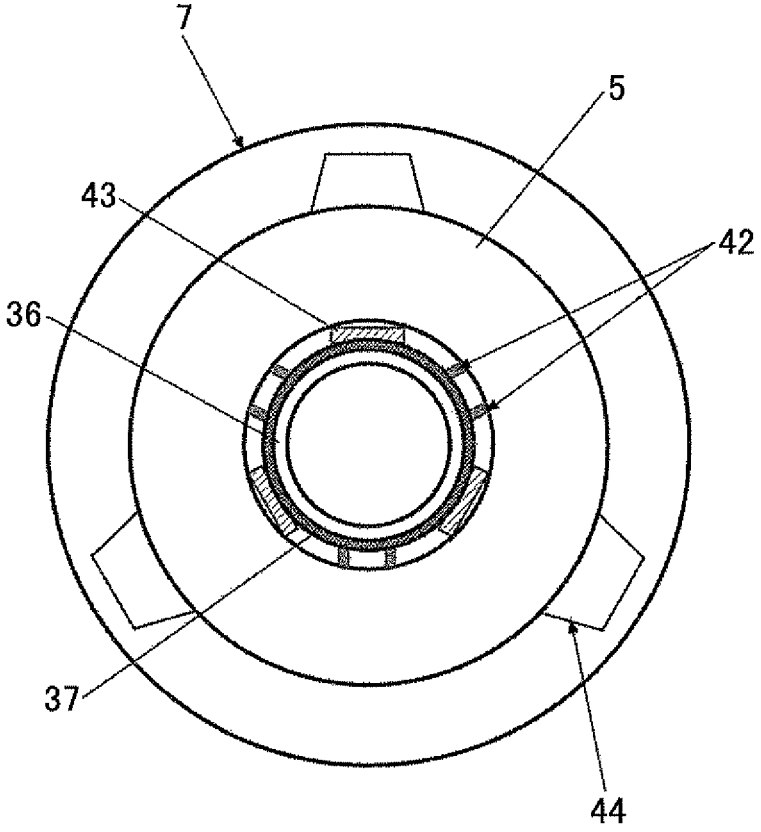
FIG. 13 shows a state where the flange fits in a core pipe of the roll sheet.

FIG. 13 shows a state where the flange 7 fits in a core pipe 5*a* (see FIG. 14) of the roll sheet 5. The rib-shaped guides 42 of the core part 37 are provided so as to contact the core pipe 5*a*, which facilitates the installation of the roll sheet 5 into the flange 7. Further, it is also possible to reduce positional deviation between the center of the roll sheet 5 and the center of the shaft member 36 and avoid unnecessary deformation of the elastic members 43.

Figure 14:
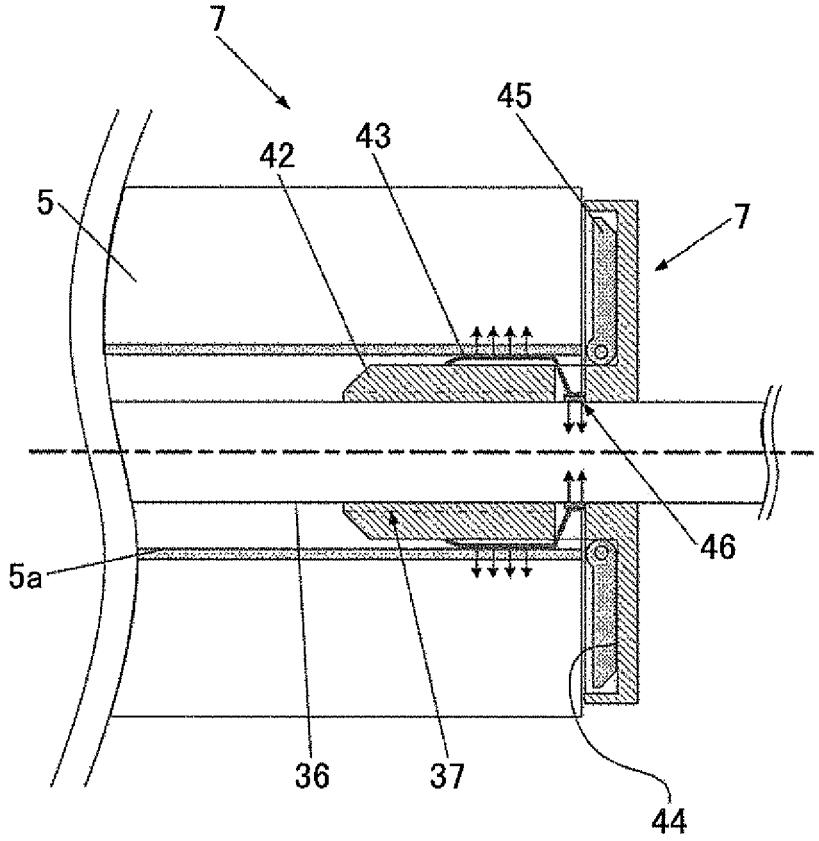
FIG. 14 shows a state where the movable flange is attached to the roll sheet of which the core pipe has a small inner diameter.

FIG. 14 shows a state where the flange 7 is attached to the roll sheet 5 of which the core pipe 5*a* has a small inner diameter. As shown in FIG. 14, the tip-end sides (left-side parts in FIG. 14, i.e., most parts of the elastic members 43) of the elastic members 43 positioned between the core pipe 5*a* and the guides 42 are brought into contact with the inner peripheral surface of the core pipe 5*a* of the roll sheet 5 and deformed in the radius direction of the core pipe 5*a*. Consequently, contact pressure (as indicated by small arrows that represent forces applied in opposite directions in FIG. 14) is applied to the inner peripheral surface of the core pipe 5*a* of the roll sheet 30 by the reaction force generated when they are deformed.

On the other hand, the base sides (right-side parts in FIG. 14 that have a small diameter and are short in the axis-line direction of the shaft member 36) of the elastic members 43 are also deformed in the radius direction of the core pipe 5*a*. Consequently, contact pressure (as indicated by small arrows that represent forces applied to a facing direction in FIG. 14) is applied to the shaft member 36. Further, in an example shown in FIG. 14, a friction member 46 such as rubber is attached to the base of the flange 7. Therefore, even if the shaft member 36 is made of a slippy material such as metal, it is possible to prevent the slippage of the shaft member 36.

Accordingly, it is possible to attach the flange 7 to the shaft member 36 without causing thrust backlash, prevent the movement of the shaft member 36 of the flange 7 in the axis-line direction and thus rotate and support the roll sheet 5, and smoothly transmit a driving force to the roll sheet 5 by the rotation of the shaft member 36.

Figure 15:
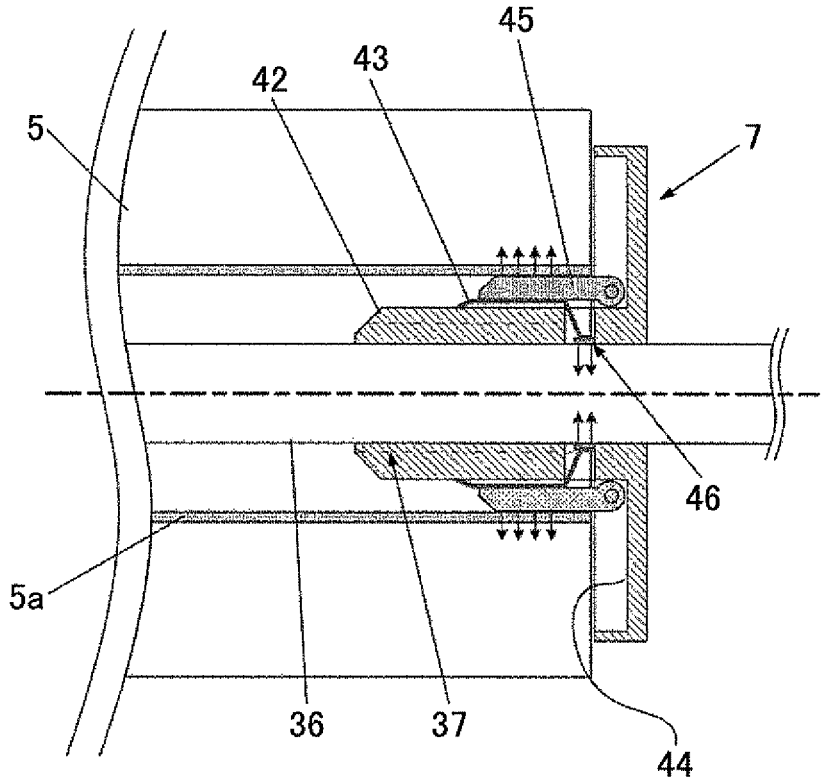
FIG. 15 shows a state where the flange is attached to the roll sheet of which the core pipe has a large inner diameter.

In FIG. 15, the flange 7 is attached to the roll sheet 5 of which the core pipe 5*a* has a large inner diameter. As shown in FIG. 15, the supporting members 45, which are placed inside the concave parts 44 of the flange 7 in the case of FIG. 14, are turned and retracted. The outer peripheral surfaces of the supporting members 45 are brought into contact with the inner peripheral surface of the core pipe 5*a* of the roll sheet 5 and thus deformed in the radius direction of the core pipe 5*a*. Consequently, contact pressure is applied to the inner peripheral surface of the core pipe 5*a* of the roll sheet 5 by the reaction force generated when they are deformed. Note that FIG. 15 is similar to FIG. 14 in that the base sides of the elastic members 43 apply contact pressure to the shaft member 36. Further, deformation of the elastic members 43 with the supporting members 45 makes it possible to deal with the core pipe 5*a* of the roll sheet 5 having a different inner diameter.

(Fifth Embodiment)

Figure 16A:
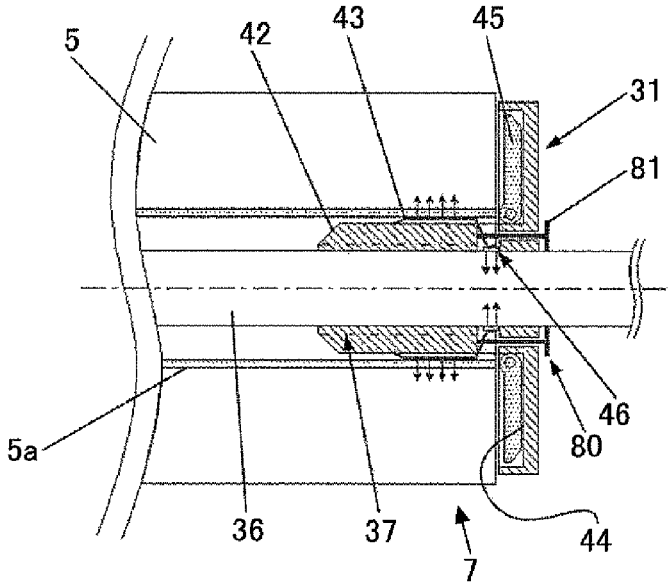
FIGS. 16A and 16B are cross-sectional views showing a fifth embodiment of the present invention.
Figure 16B:
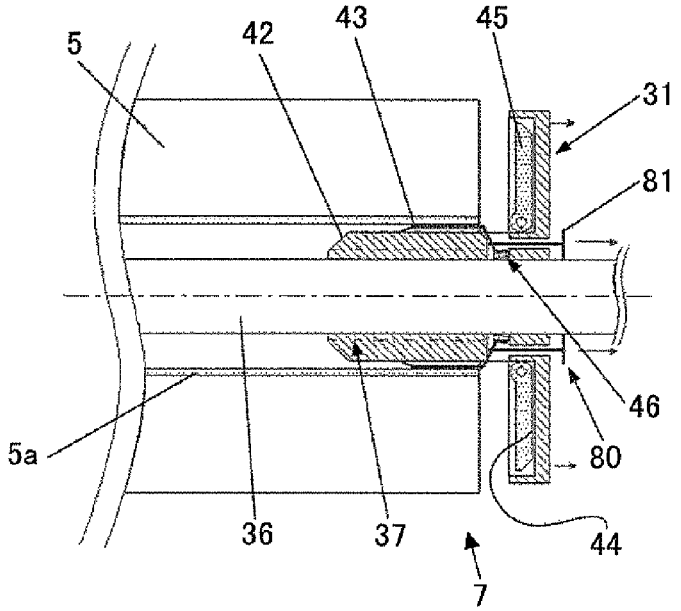

FIGS. 16A and 16B are cross-sectional views showing the fifth embodiment of the present invention. In this embodiment, the flange 7 is provided with a releasing member 80 for detachment. Thus, the core part 37 is easily detached from the shaft member 36 when the flange 7 is operated from its outside. The tip end of the releasing member 80, i.e., the tip end that penetrates inside the core pipe 5*a* of the roll sheet 5 is attached so as to hook into the slant portions (portions that connect a large-diameter tip end part and a small-diameter end part to each other) of the base parts of the elastic members 43. The attachment of the tip end of the releasing member 80 to the base parts of the elastic members 43 is not limited to hooking but can employ various ways such as adhesion. Further, the base of the releasing member 80, i.e., the portion of the releasing member 80 positioned outside the flange 7 has a projecting part 81 (or anything such as a projecting surface part that has a diameter larger than that of the tip end and projects in the outer peripheral direction of the flange 7), on which an operator can easily put his/her hand as shown in FIGS. 16A and 16B.

In FIG. 16A, the releasing member 80 is attached to the flange 7, wherein the tip end hooks into the base parts of the elastic members 43. When the operator extracts the releasing member 80 in this state while holding the projecting part 81, the elastic members 43 are pulled by the releasing member 80. Consequently, because of the deformation of the elastic members 43, the flange 7 and the core part 37 can be easily extracted from the core pipe 5*a* of the roll sheet 5 even in the face of contact pressure applied between the inner peripheral surface of the core pipe 5*a* of the roll sheet 5 and the outer peripheral surfaces of the elastic members 43 (see FIG. 16B). Note that although omitted in FIGS. 16A and 16B, the same effect can be achieved even in a case where the supporting members 45 are used as in the case of FIG. 15.

The present invention is not limited to the specifically disclosed embodiments, and variations and modifications may be made without departing from the scope of the present invention.

The present application is based on Japanese Priority Application Nos. 2010-174835 filed on Aug. 3, 2010 and 2010-215582 filed on Sep. 27, 2010, the entire contents of which are hereby incorporated herein by reference.

What is claimed is:

1. A roll medium holding unit comprising:

a contact plate perpendicular to an axial direction of a core pipe of a roll medium and including recessed portions disposed therein;

a core part projecting in said axial direction from the contact plate and configured to be inserted in said core pipe of said roll medium; and plural diameter-increasing members configured to be variably arranged at corresponding first positions provided parallel to the core part along a periphery of the core part and arranged at corresponding second positions provided in the recessed portions of the contact plate and extending perpendicular to the core part;

wherein in a first holding state of the roll medium holding unit, the diameter-increasing members arranged at an outer peripheral surface of the core part support the roll medium with the diameter-increasing members arranged at the corresponding first positions, and in a second holding state of the roll medium holding unit, the core part supports the roll medium with the diameter-increasing members arranged at the corresponding second positions provided in the recessed portions of the contact plate, wherein each diameter-increasing member amongst the plural diameter-increasing members is supported about corresponding rotation supporting points which are provided at a base part of the core part, and wherein the diameter-increasing member includes a plate portion and rotates about the rotation supporting points from the first position in which the plate portion extends along, and is in contact with, the outer peripheral surface of the core part, to the second position provided in the corresponding recessed portion of the contact plate to accommodate the diameter-increasing member, and in said second position, the same plate portion that was in contact with the outer peripheral surface of the core part when the diameter-increasing member was in the first position extends lengthwise in a radially outward direction from the core part, while being separated from the core part.

2. The roll medium holding unit according to claim 1, wherein when the diameter-increasing members are rotated from the corresponding first positions to the corresponding second positions, tip ends of the diameter-increasing members swing in a direction going from the corresponding first positions to the corresponding second positions.

3. The roll medium holding unit according to claim 1, further comprising:

elastic members configured to be arranged at the outer peripheral surface of the core part and to be deformable in a radius direction thereof; wherein the elastic members are deformed in the radius direction in such a manner that the diameter-increasing members are brought into contact with the elastic members when the diameter-increasing members are arranged at the corresponding first positions.

4. The roll medium holding unit according to claim 1, further comprising:

a holding mechanism configured to hold the diameter-increasing members at one of the corresponding first positions and the corresponding second positions.

5. An image forming apparatus comprising the roll medium holding unit according to claim 1.

* * * * *